US005890839A

United States Patent [19]

Gunter

[11] Patent Number: 5,890,839

[45] Date of Patent: Apr. 6, 1999

[54] TRENCH FORMING ASSEMBLY HAVING A COUNTERBUOYANCY MEMBER AND ASSOCIATED METHOD

[75] Inventor: Charles E. Gunter, Mooresville, N.C.

[73] Assignee: ABT, Inc., Troutman, N.C.

[21] Appl. No.: 718,372

[22] PCT Filed: Nov. 20, 1995

[86] PCT No.: PCT/US95/15143

§ 371 Date: Sep. 25, 1996

§ 102(e) Date: Sep. 25, 1996

[87] PCT Pub. No.: WO97/19228

PCT Pub. Date: May 29, 1997

[51] Int. Cl.[6] ..... E02B 5/00

[52] U.S. Cl. ..... 405/119; 249/10; 405/118; 404/4

[58] Field of Search ..... 405/118–121; 404/2, 4; 249/9–13

[56] References Cited

U.S. PATENT DOCUMENTS

| | | |
|---|---|---|
| 4,844,655 | 7/1989 | Aleshire . |
| 4,878,782 | 11/1989 | Beattie et al. . |
| 4,957,268 | 9/1990 | Picollo et al. . |
| 4,993,877 | 2/1991 | Beamer . |
| 4,993,878 | 2/1991 | Beamer . |
| 5,000,621 | 3/1991 | Beamer . |
| 5,066,165 | 11/1991 | Wofford et al. . |
| 5,281,051 | 1/1994 | Stegall . |
| 5,326,189 | 7/1994 | Beamer . |
| 5,348,421 | 9/1994 | Stegall . |
| 5,393,171 | 2/1995 | Stegall . |
| 5,399,047 | 3/1995 | Stegall . |

OTHER PUBLICATIONS

*ACO Drain® Technical Installation Easy Installation With ACO's Precast, Interlocking Trench Drain System* pamphlet by ACO Polymer Products, Inc.

*Suggested Forming Procedures For Installing Neenah Drainage Structures* pamphlet by Neenah Foundry Company, 1986.

*Polydrain® The Simple Solution To Surface Drainage* pamphlet by ABT, Inc., Jul. 1989.

*Polydrain® Installatin Notes* pamphlet by ABT, Inc., Oct. 1989.

*Polydrain® The Simple Solution To Surface Drainage Design Professionals Manual* by ABT, Inc., Jan. 1991.

*Trench Former System™* pamphlet by ABT, Inc., Jun. 1992.

*Trench Former System™* pamphlet by ABT, Inc., Jun. 1992.

*Primary Examiner*—Dennis L. Taylor

*Attorney, Agent, or Firm*—Bell Seltzer Intellectual Property Law Group of Alston & Bird, LLP

[57] ABSTRACT

A trench forming assembly for forming a trench of predetermined shaped is disclosed according to the present invention. The assembly includes a pair of elongate frame members for defining a support surface for supporting a trench cover and at least one downwardly extending leg attached to each frame member for anchoring the frame members in a predetermined location. The assembly also includes a form body for shaping a hardenable trench forming composition into the predetermined shape of the trench and having an upper surface, opposed side surfaces and a bottom surface. The trench forming assembly further includes at least one counterbuoyancy member extending between the frame members and having a generally downwardly facing engagement surface for operatively engaging a portion of the upper surface of the buoyant form body between the frame members. The counterbuoyancy member can also have an upper surface, opposite the engagement surface, for operatively engaging the elongate frame members. Accordingly, the combination of the counterbuoyancy member, the pair of elongate frame members and the downwardly extending legs cooperate to substantially counterbalance the buoyant form body against upward flotation forces applied to the form body by a hardenable trench forming composition poured around portions of the buoyant form body.

43 Claims, 5 Drawing Sheets

TRENCH FORMING ASSEMBLY HAVING A COUNTERBUOYANCY MEMBER AND ASSOCIATED METHOD

FIELD THE INVENTION

The present invention relates generally to methods and apparatus for forming trenches and, more particularly, to methods and apparatus for forming a trench employing a buoyant form body.

BACKGROUND OF THE INVENTION

Drainage and other trenches of various sizes and shapes are desirable for numerous applications. For example, manufacturing facilities typically require drainage systems which include trenches formed in the building floors to collect, remove and/or recycle excess water or other liquids. In addition, numerous outdoor industrial and commercial sites, such as parking lots, require drainage systems, including trenches, to collect and direct rainwater and other liquids to underground storm sewers to prevent flooding and to decrease runoff.

Furthermore, with increasing emphasis being placed on protecting the environment from ecological hazards, a number of relatively stringent environmental regulations have been adopted which restrict the types of materials which can be discharged into drainage systems. In particular, regulations have been enacted which limit the amount of oil and grease which may be discharged into drainage systems. Consequently, drainage systems, such as the drainage systems installed in gasoline stations, chemical transfer stations, oil storage areas and landfills, can include one or more oil water separators to separate solid debris, free oils and other non-soluble chemicals from the waste water.

In the past, the trenches, including oil water separators, which form these drainage systems have generally been formed by initially placing and securing a form of predetermined shape in a ditch which has previously been formed in the ground. A moldable trench forming composition, such as cement, concrete, or the like, is then poured around the form and is allowed to set. Once the concrete has set, the form is removed from the resulting trench.

One common type of form assembly used to define a trench includes a wooden frame and strut structure. The wooden form includes a wooden frame which is covered with wooden sheets or planks to define a generally rectangular elongate trough. The wooden form is generally enclosed along its side and bottom surfaces, but can have an open top. Typically, a number of supporting wooden ribs are installed within the wooden form to increase the strength of the form so that it can withstand the relatively large pressures exerted by moldable trench forming compositions poured about the form.

During installation, the wooden form is placed and secured within a preformed ditch. Concrete is initially poured in lower portions of the preformed ditch up to the bottom surface of the form. Once this initial pour of concrete has set, additional concrete is then poured between the earthen walls of the ditch and the wooden side surfaces of the form. Once this additional concrete has set, the wooden form is disassembled and removed from the trench.

It is normally desirable to finish the trench with an elongate grate covering its open top in order to prevent people from unwittingly stepping in the open trench, to provide a smooth surface for vehicle travel, and/or to prevent relatively large objects from entering the trench and potentially blocking the flow of liquid therethrough. The grate is generally supported by a pair of spaced apart frame members which are set into and extend from the walls of the concrete trench. In order to stabilize the grate and to prevent the grate from rocking when weight, such as from a passing vehicle, is applied thereto, it is important that the frame members are aligned in a common plane during the pouring and setting of the concrete about the wooden form.

Wooden forms are generally formed of lumber having a relatively rough exterior texture. Correspondingly, the inside surface of the resulting trench formed by the wooden form is relatively uneven, thereby reducing the efficiency with which liquid flows through the trench. In addition, the assembly and disassembly of the wooden forms is both costly and labor intensive. The relatively large costs and labor required for assembly and disassembly of the wooden forms is increased in the formation of long trenches, and even further increased in the formation of trenches having a pitched or slanted bottom surface to facilitate drainage.

As an alternative to wooden forms, precast trench assemblies have been developed. Precast trench assemblies generally include preformed metal and/or plastic assemblies designed to be placed in a ditch. Moldable trench forming composition can thereafter be poured about the precast trench assembly. Once the trench forming composition has set, the precast trench assembly is securely bonded to the trench forming composition which stabilizes and supports the trench. Precast trench assemblies, however, are relatively expensive and cannot generally be reused.

In order to overcome at least some of the shortcomings of wooden forms and precast trench assemblies, a trench forming apparatus and associated method which employ an improved removable form to define the shape of the resulting trench are disclosed in several U.S. Patents to Stegall, including U.S. Pat. No. 5,281,051 which issued Jan. 25, 1994, U.S. Pat. No. 5,348,421 which issued Sep. 20, 1994 and U.S. Pat. No. 5,393,171 which issued Feb. 28, 1995; each of which are assigned to ABT, Inc. of Troutman, N.C., the assignee of the present invention. The trench forming apparatus disclosed in the Stegall patents preferably includes longitudinal frame members having a plurality of anchoring legs extending downwardly therefrom. The elongate form body, typically formed of relatively lightweight expanded polystyrene, preferably includes generally upwardly facing surfaces associated with the opposed side walls of the form body for engaging the frame members. In one advantageous embodiment, the opposed side walls of the form body include aligned longitudinal slots which define respective ones of the upwardly facing surfaces for receiving and engaging the frame members. In particular, horizontal portions of the frame members are engaged by the generally upwardly facing surfaces of the opposed side walls so that the frame members are held in alignment during the trench forming operation. In typical practice, one or more wires are wrapped around the outside of the form body and frame members to hold the frame members in engagement with the generally upwardly facing surfaces defined by the opposed side walls of the form.

Preferably, the assembled form and frame members are placed into a preformed ditch by suspending the assembly from its top. A subslab of trench forming composition is initially poured around lower portions of the anchoring legs and is allowed to set. A second pour of trench forming composition is then poured around the form body and is allowed to set. Finally, the form body is removed from the hardened trench forming composition to expose the resulting trench and the properly aligned frame members. According to one advantageous embodiment, the form includes a pair of slots extending a relatively short distance into the form body from its bottom surface in order to facilitate removal of the form. The trench forming assembly can also include wires disposed within the slots such that, once the trench forming composition has set, the wires can be pulled upwardly through the form. The form body is thereby cut into several pieces that can be more easily removed from the resulting trench.

During the trench forming process described above, the moldable trench forming composition will exert an upwardly directed buoyant force on the buoyant form body. Thus, in addition to holding the frame members in alignment during the trench forming process, the engagement of the generally upwardly facing surfaces of the form body with respective horizontal portions of the frame members at least partially counters this buoyant force exerted on the form body by the moldable trench forming composition. In particular, the frame members and, in turn, the form body are held in position relative to the ground due to the secure engagement of the downwardly extending legs within the concrete subslab. Consequently, the engagement of the generally upwardly facing surfaces of the form body with the frame members is also designed to hold the form body substantially against upward movement during the trench forming process.

The upwardly directed buoyant force exerted on the form body during the trench forming process is directly proportional to the volume of the form about which the moldable trench forming composition is poured. Thus, larger form bodies which create correspondingly larger trenches are subjected to greater buoyant forces. However, the surface area of the generally upwardly facing surfaces of the form body which engage respective horizontal portions of the frame members to align the frame members and to counter the buoyant forces is generally limited to the corresponding surface area of the horizontal portions of the frame members.

Consequently, for a trench forming apparatus having frame members which include horizontal portions of a predetermined size for engaging a relatively large form body, the upwardly directed buoyant forces exerted on the relatively large form body may overcome the compensatory forces provided by the engagement of the upwardly facing surfaces of the form body with the frame members and force the form body upwardly from the trench. If the form body is forced upwardly from the trench by the upwardly directed buoyant forces, the form body is typically destroyed and that portion of the trench must generally be reformed in order to properly shape or form the trench.

SUMMARY OF THE INVENTION

The present invention provides improved trench forming methods and apparatus. In one aspect, the invention provides trench forming systems that employ one or more counterbuoyancy members for operatively engaging the buoyant form body and, in combination with other elements of the trench forming apparatus, for counterbalancing the buoyant form body against the flotation forces applied by the hardenable trench forming composition poured about the buoyant form body. Consequently, the trench forming system of the present invention is well suited to hold relatively large buoyant form bodies against upward movement during the trench forming process. In another aspect, the counterbuoyancy member of the trench forming systems of the present invention can also operatively engage and maintain the frame members in a predetermined coplanar relationship so that the frame members can support a trench cover or grate in a stable and aligned position.

In one aspect, the trench forming apparatus of the present invention includes a pair of elongate frame members that define an upper surface for supporting a trench cover and an opposed lower surface, at least one downwardly extending leg connected to each of the elongate frame members and a buoyant form body which includes an upper surface, opposing side surfaces and a bottom surface for shaping a hardenable trench forming composition into the predetermined shape of the trench. According to this aspect of the present invention, the trench forming apparatus also includes at least one counterbuoyancy member extending between the pair of elongate frame members.

The counterbuoyancy frame member has an engagement surface which faces substantially downward for operatively engaging a portion of the upper surface of the buoyant form body between the pair of frame members. The counterbuoyancy member also has an upper surface, opposite the engagement surface, which preferably operatively engages the lower surface of each respective frame member. Due, at least in part, to the anchoring of lower portions of the downwardly extending legs in a subslab structure formed beneath the form body, the combination of the counterbuoyancy member, the pair of elongate frame members and the downwardly extending legs cooperate to substantially counterbalance the buoyant form body against upward flotation forces applied thereto by the hardenable trench forming composition poured around at least portions of the buoyant form body. Consequently, the trench forming apparatus of the present invention can securely hold relatively large buoyant form bodies during the trench forming process such that a trench of the desired size and shape can be formed.

In preferred embodiments, the operative engagement of the counterbuoyancy member and the pair of elongate frame members maintains the frame members in a predetermined coplanar relationship. The frame members can therefore support a trench cover or grate over the completed trench in a stable and aligned position. In one advantageous embodiment, the engagement surface of the counterbuoyancy member has a predetermined surface area of at least about 30 square inches. Therefore, the upward flotation force applied to the buoyant form body by the hardenable trench forming composition can be distributed across this predetermined surface area of the engagement surface so that relatively large form bodies can be held in position during the trench forming process. For example, the trench forming apparatus of the present invention which includes at least one counterbuoyancy member can effectively counterbalance the flotation forces applied to a buoyant form body which substantially defines the predetermined shape of an oil water separator having a volume of at least about 25 cubic feet.

In one embodiment, the buoyant form body extends lengthwise to define an elongate trench. The counterbuoyancy member preferably includes a plurality of counterbuoyancy members which extend laterally across the lengthwise extending buoyant form body in a predetermined spaced relationship. Additionally, the buoyant form body and the counterbuoyancy members are preferably sized such that the end portions of the counterbuoyancy members are flush with adjacent portions of the respective side surfaces of the buoyant form body. Thus, the trench forming apparatus of this embodiment can form a trench having relatively smooth walls. The buoyant form body can also define at least one groove in the upper surface thereof which has a predetermined size adapted to receive a respective counterbuoyancy member.

In addition, the counterbuoyancy member is generally comprised of a material, such as wood, which has a greater strength of compression and/or a greater flexural strength than the material which forms the buoyant form body, such as foamed plastic. Consequently, the counterbuoyancy member can effectively resist or counter the upwardly directed flotation forces applied to the buoyant form body by the hardenable trench forming composition.

According to one advantageous embodiment, the buoyant form body can also include generally upwardly facing surfaces associated with the opposed side surfaces. For example, the upwardly facing surfaces can form portions of respective slots defined in the opposed side surfaces of the form body. The upwardly facing surfaces preferably engage the lower surfaces of the frame members along at least a portion of the length thereof. Thus, the buoyant form body is further counterbalanced against upward flotation forces applied by the hardenable trench forming composition poured around the buoyant form body by this engagement of the upwardly facing surfaces of the form body with the frame members. In one particularly advantageous embodiment, the generally upwardly facing surfaces associated with the opposed side surfaces of the buoyant form body are substantially aligned with the upper surface of the counterbuoyancy member. The lower surfaces of the frame members of this embodiment can therefore be engaged by both the upwardly facing surfaces of the form body and the upper surface of the counterbuoyancy member.

Each of the various embodiments of the trench forming apparatus effectively holds the buoyant form body in position while the trench forming composition is poured and sets around the form body. Once the hardenable trench forming composition has set, the buoyant form body can then be removed from the trench. In order to remove the form body from the completed trench, the counterbuoyancy members can be cut and removed prior to removing the form body.

Therefore, the trench forming apparatus according to the various embodiments of the present invention can substantially counterbalance relatively large buoyant form bodies against the significant upward flotation forces applied by the hardenable trench forming composition poured thereabout. Thus, the trench forming method and apparatus of the present invention can reliably form relatively large trenches, including oil water separators, without destruction or misalignment of the buoyant form bodies by the upward flotation forces generated during the trench forming process. In addition, the operative engagement of the counterbuoyancy member with the frame members according to the present invention can substantially align the frame member such that the frame member can support a trench cover or grate in a stable and aligned position over the resulting trench.

BRIEF DESCRIPTION OF THE DRAWINGS

In the drawings which form a portion of the original disclosure of this application.

DETAILED DESCRIPTION OF THE PREFERRED EMBODIMENT

Figure 1:
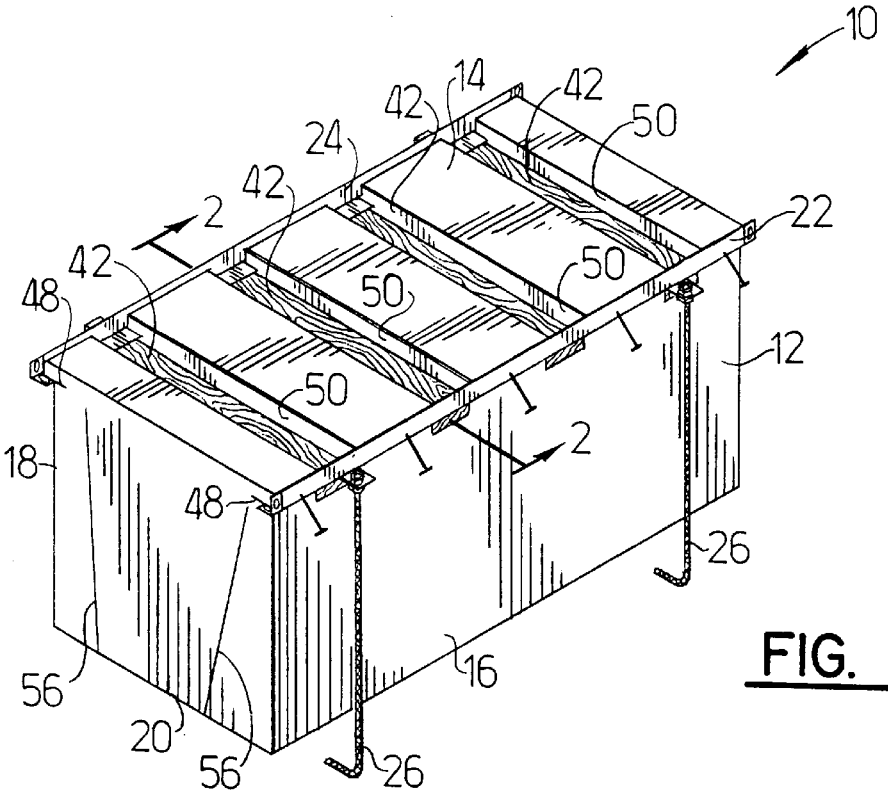
FIG. 1 is a perspective view of one preferred trench forming apparatus, following assembly thereof, for forming a drainage trench and which also includes a plurality of counterbuoyancy members extending between a pair of elongate frame members.

In the following detailed description, preferred method and apparatus embodiments of the invention are described in detail. Although the invention is described with reference to these specific preferred methods and apparatus, including those illustrated in the drawings, it will be understood that the invention is not intended to be so limited. To the contrary, the invention includes numerous alternatives, modifications and equivalents as will become apparent from the consideration of the foregoing discussion and the following detailed description.

Figure 2:
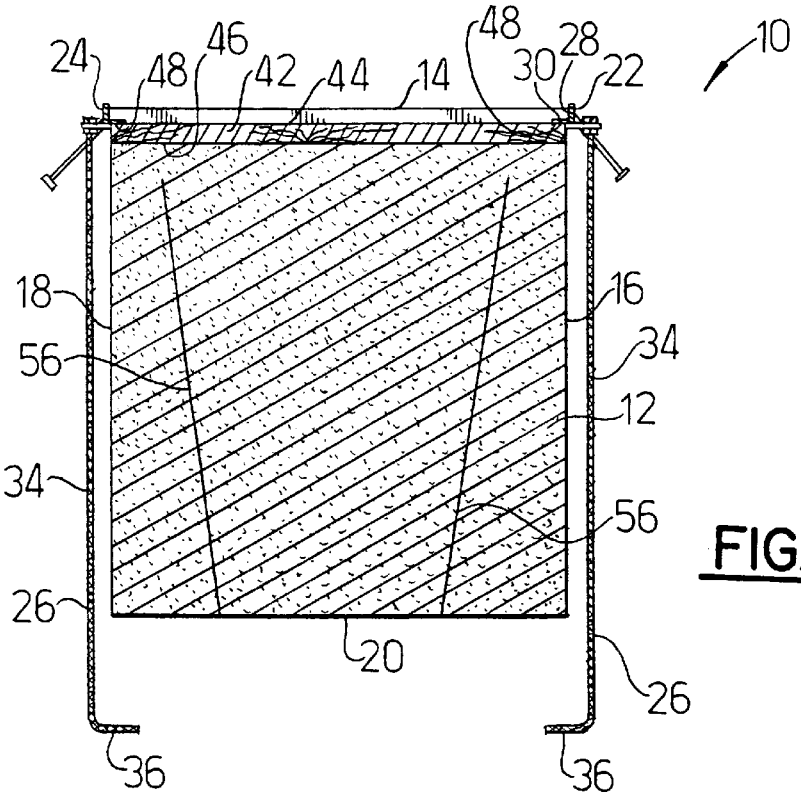
FIG. 2 is a cross-sectional view of the assembled trench forming apparatus of FIG. 1 taken along line 2—2 and which illustrates a counterbuoyancy member extending between and contacting the lower surfaces of a pair of elongate frame members.
Figure 3:
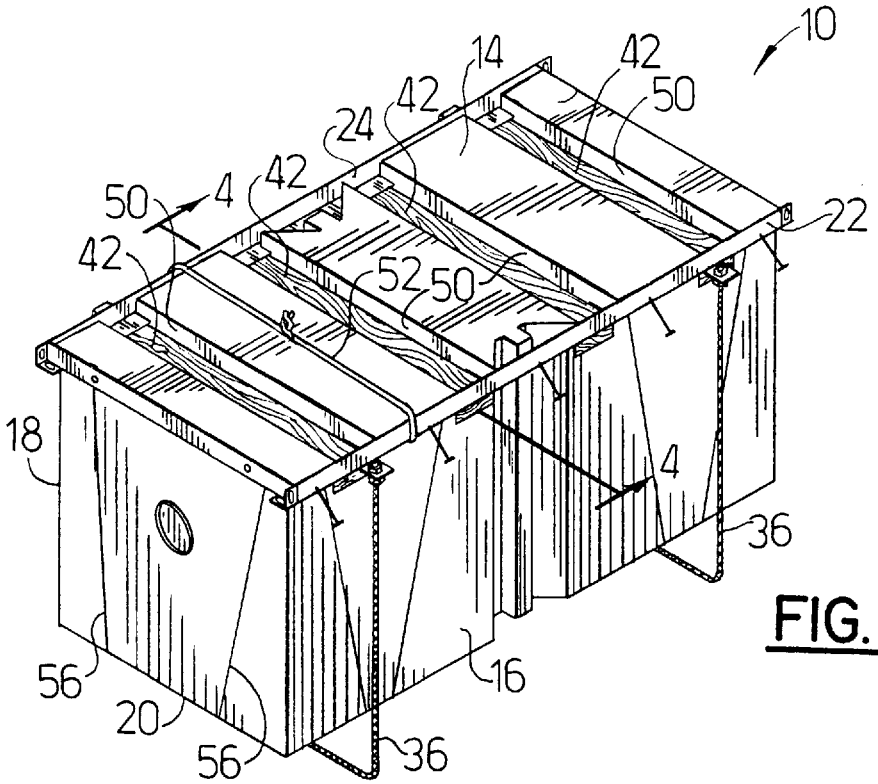
FIG. 3 is a perspective view of another preferred trench forming apparatus, following assembly thereof, for forming an oil water separator and which includes a plurality of counterbuoyancy members extending between a pair of elongate frame members.
Figure 4:
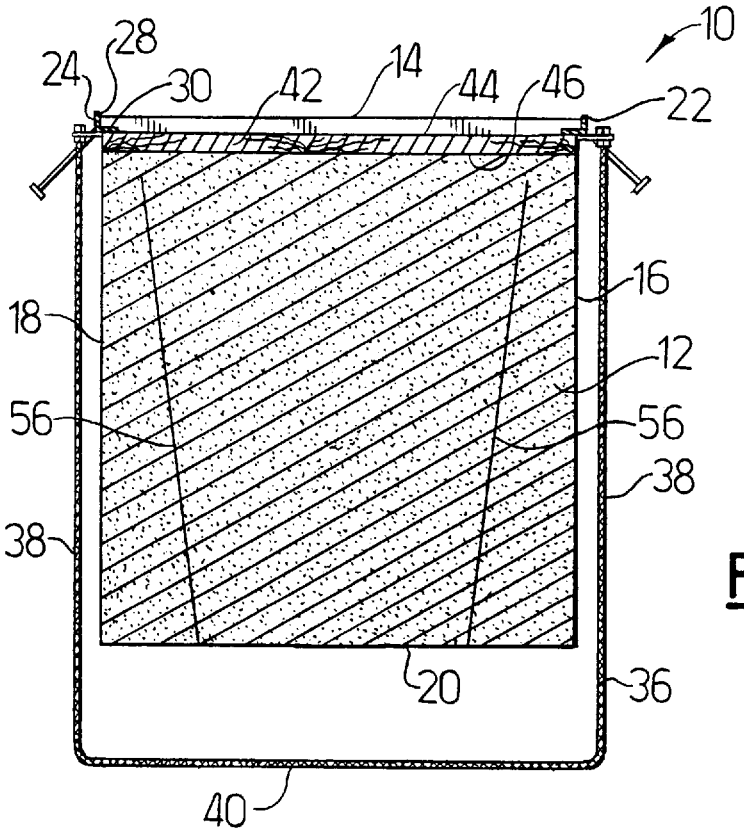
FIG. 4 is a cross-sectional view of the assembled trench forming apparatus of FIG. 3 taken along line 4—4 and which illustrates a counterbuoyancy member extending between and contacting the lower surfaces of a pair of elongate frame members.

As illustrated in FIGS. 1 and 2, a trench forming assembly 10 of one embodiment of the present invention includes a buoyant form body 12 which is preferably made from a lightweight inexpensive material such as a foamed plastic. For example, the form body can be made from expanded polystyrene. The buoyant form body typically includes an upper surface 14, opposing side surfaces 16 and 18 and a bottom surface 20 for defining the predetermined shape of the trench. However, the buoyant form body can be generally V-shaped or U-shaped such that lower portions of the opposing side surfaces also form the bottom surface of the trench. In addition, while the buoyant form body can extend lengthwise as shown in FIG. 1 to define an elongate trench, the buoyant form body can also define other types of drainage structures, including oil water separators as shown in FIGS. 3 and 4, which are not elongate, but which have a rectangular solid or other shape.

The trench forming assembly 10 also includes a pair of opposed frame members 22 and 24 and at least one and, more preferably, a plurality of downwardly extending legs 26 connected to each of the frame members. Each of the frame members typically includes an elongate vertically oriented portion 26 and an elongate horizontally oriented portion 28. The horizontally oriented elongate portions are preferably aligned in a coplanar relationship and, more preferably, a parallel relationship so as to define a support surface for a trench cover or grate 32 member which covers the finished trench. Typically, the horizontal portions of the elongate frame members serve directly as the support surface for the grate. Alternatively, the horizontal portions can shape a portion of the trench forming composition into a flat surface which, in turn, serves as the support surface for the grate.

The elongate frame members 22 and 24 and the plurality of downwardly extending legs 26 are advantageously formed of any of various well-known metal materials. It will also be apparent, however, that the frame members and the downwardly extending legs could be formed from plastics or other materials if so desired.

Additional details regarding the elongate frame members 22 and 24 and the downwardly extending legs 26 as well as various features of the buoyant form body 12 are described in considerable detail in U.S. Pat. No. 5,281,051 to Lannie L. Stegall which issued Jan. 25, 1994, U.S. Pat. No. 5,348, 421 to Lannie L. Stegall which issued Sep. 20, 1994 and U.S. Pat. No. 5,393,171 to Lannie L. Stegall which issued Feb. 28, 1995. For the sake of brevity, various details disclosed in the foregoing patents are not repeated herein. However, reference may be had to these patents for further details. In addition, although a trench forming apparatus which includes right angled elongate frame members is described and illustrated, frame members of different shapes can also be employed in the invention. These frame members can have various cross sectional shapes as more fully illustrated in U.S. patent application, Ser. No. 08/121,042, entitled "METHOD AND APPARATUS FOR FORMING A TRENCH" to Lannie L. Stegall which was filed on Sep. 13, 1993 and which is incorporated herein by reference.

Additionally, the downwardly extending legs 26 are shown and described herein as comprising a substantially downwardly extending leg portion 34 and an associated foot 36 connected to lower portions thereof. However, the downwardly extending anchoring legs can be formed by a generally U-shaped anchoring structure as shown in FIGS. 3 and 4. The generally U-shaped anchoring structure typically includes a pair of leg portions 38 connected to respective ones of the elongate frame members and an integral horizontal member 40 which joins the leg portions at their lower ends. Further details regarding these generally U-shaped anchoring structures are provided in U.S. Pat. No. 5,399,047 to Lannie L. Stegall which issued Mar. 21, 1995.

As shown in FIG. 1, the trench forming apparatus 10 also includes at least one and, more preferably, a plurality of counterbuoyancy members 42 extending between the pair of elongate frame members 22 and 24. While the counterbuoyancy members are generally rectangular in cross-section as shown, the counterbuoyancy members can have a variety of cross-sectional shapes without departing from the spirit and scope of the present invention. Each counterbuoyancy member typically has an upper surface 44 and an opposed lower or engagement surface 46. The engagement surface of each counterbuoyancy member preferably faces substantially downward so as to operatively engage a portion of the upper surface 14 of the buoyant form body 12 between the frame members. More preferably, the substantially downward facing engagement surface contacts a portion of the upper surface of the form body between the frame members. Accordingly, the counterbuoyancy members, in combination with the elongate frame members and the downwardly extending legs 36, cooperate to substantially counterbalance the buoyant form body against upward flotation forces applied to the form body by the hardenable trench forming composition poured around portions of the buoyant form body as described in detail hereinafter.

In one advantageous embodiment illustrated in FIG. 1, the trench forming apparatus 10 includes a number of counterbuoyancy members 42 which extend laterally across the buoyant form body 12. As shown, the counterbuoyancy members are spaced lengthwise along the buoyant form body. However, even though the counterbuoyancy members are spaced in equal increments along the length of the elongate form bodies of FIGS. 1 and 3, the counterbuoyancy members can be irregularly spaced without departing from the spirit and scope of the present invention. For example, the counterbuoyancy members can be positioned with different spacings therebetween.

In order to effectively counterbalance the flotation forces applied to the buoyant form body 12, the counterbuoyancy member 42 is preferably comprised of a material having a greater strength of compression than that of the material forming the buoyant form body. In a number of instances, such as installations in which the form body is relatively wide and thin, the counterbuoyancy member also preferably has a greater flexural strength than that of the material forming the buoyant form body. For example, the counterbuoyancy member can be wooden, metallic, fiberglass or plastic and the buoyant form body can be a foamed plastic. In addition, while a number of lengthwise spaced apart counterbuoyancy members are described above and illustrated in FIG. 1, the counterbuoyancy member can comprise a sheet of material, such as a wooden, metallic, fiberglass or plastic sheet, which extends across and operatively engages a relatively large portion, if not all, of the upper surface 14 of the form body which extends between the pair of opposed frame members 22 and 24 without departing from the spirit and scope of the present invention.

In one advantageous embodiment, the buoyant form body 12 and the counterbuoyancy members 42 are preferably sized such that end portions of the laterally extending counterbuoyancy members are flush with adjacent portions of the respective side surfaces 16 and 18 of the buoyant form body. Thus, the trench forming apparatus of the present invention can form trenches having relatively smooth walls with little, if any, discontinuities created by the junction or seam between the side surfaces of the form body and the end portions of the counterbuoyancy members.

Figure 9:
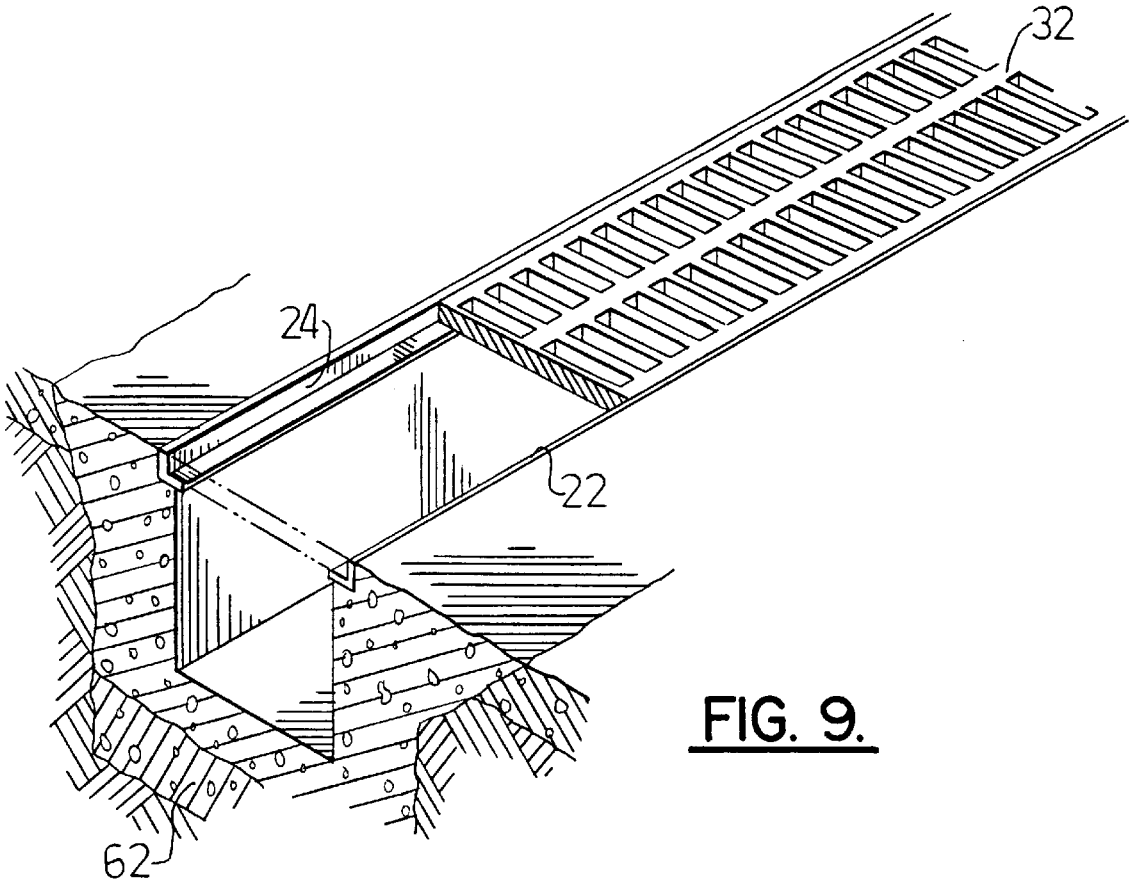
FIG. 9 illustrates a drainage trench having a trench cover or grate partially installed thereon which was formed using the trench forming apparatus and method of FIGS. 1, 2 and 5–8.

As also illustrated in FIGS. 2 and 4, the upper surface 44 of each counterbuoyancy member 42 preferably operatively engages the lower surfaces of the respective frame members 22 and 24. In particular, the upper surface of each counterbuoyancy member preferably contacts the lower surface of the pair of frame members. The counterbuoyancy members are thereby effectively held or sandwiched between the buoyant form body 12 and the pair of frame members. Consequently, the form body of this invention need not operatively engage or contact the frame member, but, instead, the counterbuoyancy member can effectively engage both the frame member and the buoyant form body. In addition to counterbalancing the flotation force applied to the buoyant form body, the operative engagement of the pair of frame members by the counterbuoyancy members maintains the frame members in a predetermined aligned relationship and, more typically, a predetermined coplanar relationship, such as a horizontally aligned relationship, during the trench forming process. As a result, following removal of the form as described below, the aligned frame members can support a trench cover or grate 32 in a stable and aligned position over the resulting trench as shown in FIG. 9.

In one advantageous embodiment illustrated in FIGS. 1 and 2, the buoyant form body 12 also includes generally upwardly facing surfaces 48 associated with the opposed side surfaces 16 and 18. The generally upwardly facing surfaces can form portions of respective slots defined in the opposed side surfaces and extending lengthwise, typically in an aligned relationship, therealong. The generally upwardly facing surfaces of this advantageous embodiment are adapted to engage the lower surfaces of the frame members 22 and 24 along at least a portion of the length thereof. Thus, the buoyant form body can be further counterbalanced against upward flotation forces applied to the form body by the hardenable trench forming composition poured thereabout. The generally upwardly facing surfaces of the opposed side surfaces of the buoyant form body are preferably aligned, such as in a predetermined aligned relationship, such that the engagement of the lower surfaces of the frame members by the generally upwardly facing surfaces also aligns the frame members, such as in a predetermined horizontal alignment. Thus, the aligned frame members can support a trench cover or grate 32 in a stable and aligned position over the resulting trench as described above.

In the preferred embodiment illustrated in FIGS. 1 and 2, the buoyant form body 12 also includes at least one groove 50 defined in the upper surface 14 thereof. Preferably, this groove has a predetermined size which matches the predetermined size of the respective counterbuoyancy member 42 such that the counterbuoyancy member can be snugly disposed therein. With respect to the advantageous embodiment described above in which the side surfaces 16 and 18 of the buoyant form body include generally upwardly facing surfaces 48 for engaging the frame members, the generally upwardly facing surfaces are preferably substantially aligned, typically in a vertical direction with the upper surface 44 of the counterbuoyancy members disposed within the grooves defined by the upper surface of the form body. Thus, both the generally upwardly facing surfaces of the buoyant form body and the upper surfaces of the counterbuoyancy members can engage or contact the lower surfaces of the pair of frame members 22 and 24, thereby cooperating to counterbalance the buoyant form body against the upward flotation forces generated during the trench forming process.

FIGS. 5–8 illustrate the formation of a trench in accordance with the present invention. In particular, the trench forming apparatus 10, including the frame members 22 and 24, the downwardly extending legs 26, the buoyant form body 12 and the counterbuoyancy member 40, is assembled as described above. As shown, one or more cords or wires 52 may extend laterally through a slot 54 formed in the upper surface 14 of the form body and around the frame members to secure the frame members to the form body, if desired. However, the cord or wire is not illustrated in each of the figures for purposes of clarity.

In addition, the illustrated buoyant form body 12 includes a pair of slots 56 which extend upwardly from the bottom surface 20 of the form body into upper portions of the form body. The upwardly extending slots defined within the form body facilitate form removal as described in detail in U.S. patent application Ser. No. 08/121,042 entitled "Method and Apparatus For Forming A Trench", the contents of which have previously been incorporated by reference. However, the form body need not include upwardly extending slots but can, instead, remain relatively undivided.

Figure 5:
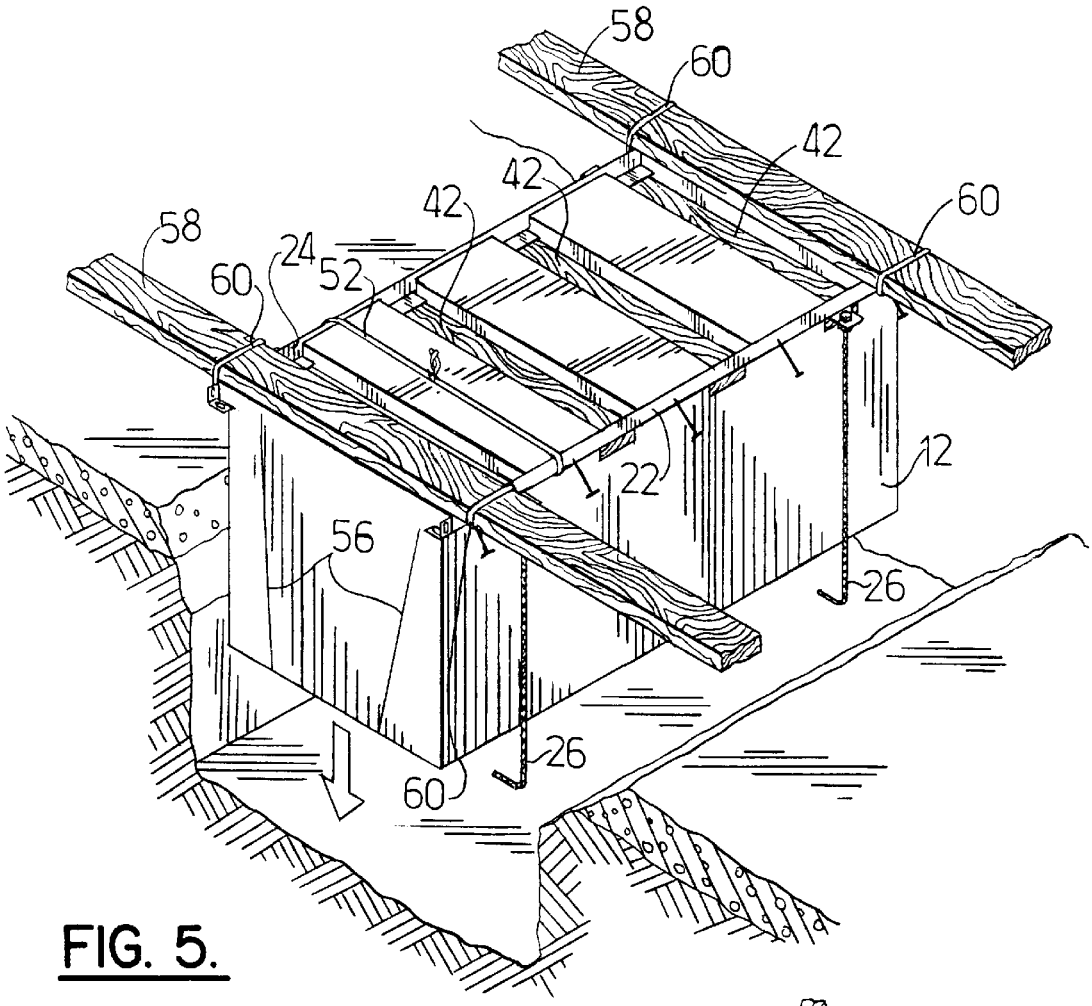
FIG. 5 is a perspective view illustrating a trench forming apparatus similar to that of FIG. 1 which is suspended over a preformed ditch by means of a plurality of suspending members, such as batter boards.
Figure 6:
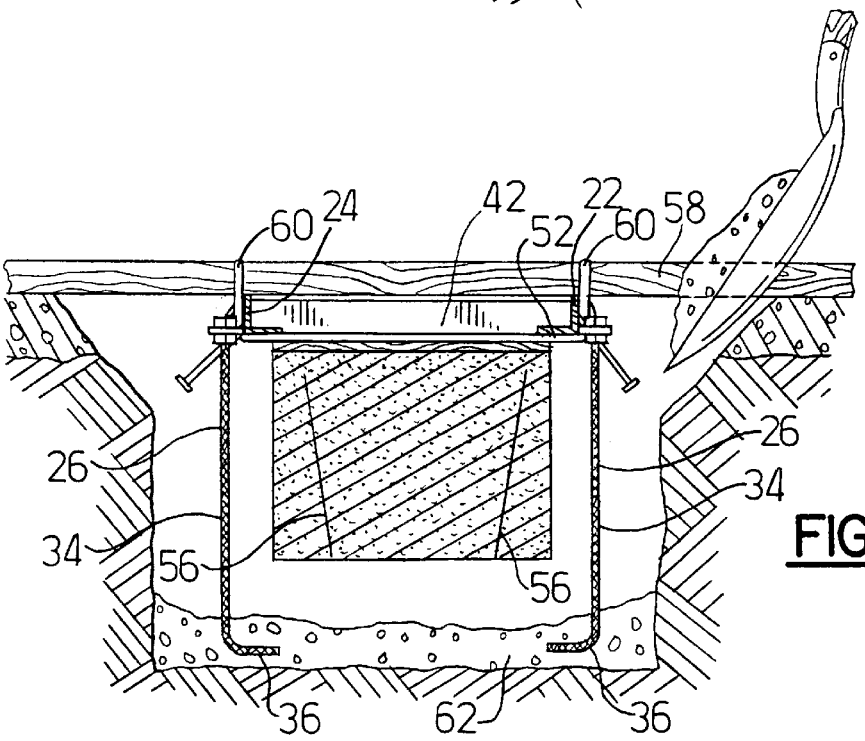
FIG. 6 is a cross-sectional view illustrating the formation of a subslab structure for anchoring lower portions of the downwardly extending legs in the bottom of the ditch.

As best shown in FIGS. 5 and 6, the trench forming assembly 10 is initially supported within a ditch via batter boards 58 which are only partially illustrated. As shown, the frame members 22 and 24 can be tied, such as via a cord or wire 60, or otherwise connected to the batter boards. A subslab structure 62 is then prepared by covering the lower portions, including the feet 36, of the downwardly extending legs 26 with a hardenable trench forming composition, such as a concrete or a cementitious material, a plastic-containing cementitious material or the like as will be apparent to those skilled in the art. The subslab structure is then allowed to set to securely bond the lower portions of the downwardly extending anchoring legs within the subslab structure.

Figure 7:
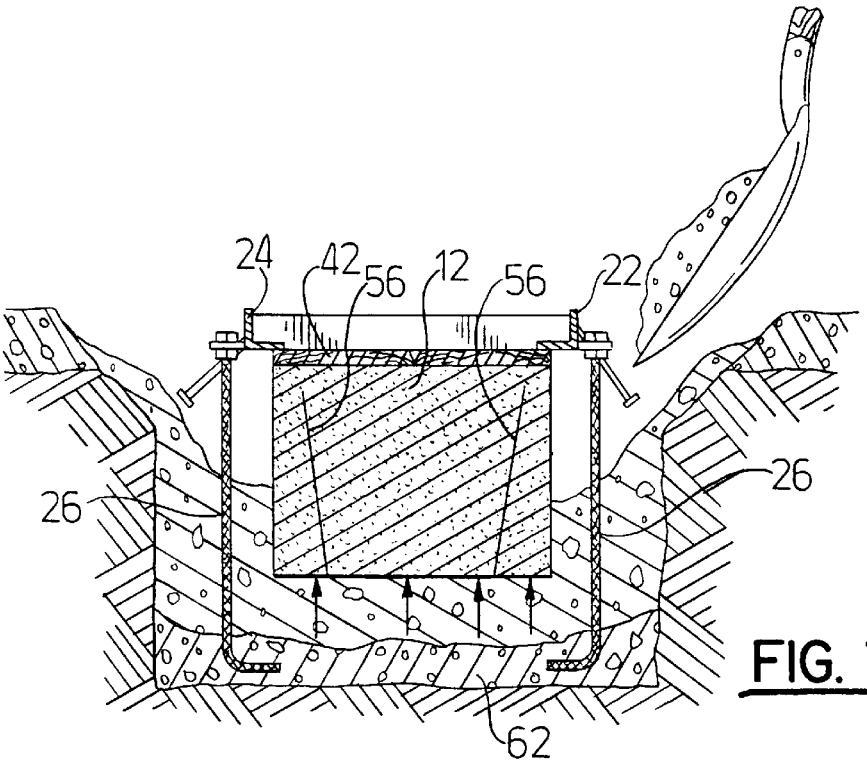
FIG. 7 is a cross-sectional view illustrating the step of pouring concrete or a similar hardenable trench forming composition around the form body following hardening or setting of the subslab structure.

As illustrated in FIG. 7, additional hardenable trench forming material is thereafter poured into the ditch around the bottom surface 20 and portions of the opposed side surfaces 16 and 18 of the buoyant form body 12. As illustrated graphically by the upwardly directed arrows of FIG. 7, the hardenable trench forming material applies an upwardly directed flotation force to the buoyant form body which attempts to displace the buoyant form body in an upward direction from the ditch. However, the upwardly directed flotation force applied by the hardenable trench forming composition is offset or counterbalanced by the engagement of a buoyant form body by the counterbuoyancy members 42 and, in some embodiments, the frame members 22 and 24. In particular, the upwardly directed flotation force applied by the hardenable trench forming composition attempts to force the buoyant form body upward and, in turn, forces the counterbuoyancy members against the lower surface of the respective frame member. However, the frame members are held in position due to the secure bonding of the downwardly extending legs 26 within the subslab structure 62. Thus, the frame members and the counterbuoyancy members resist the upward flotation forces applied to the buoyant form body so that the buoyant form body is held in position.

The flotation force to which the form body 12 is subjected can be determined by the product of the volume $V_{FORM}$ of the buoyant form body and the flotation force F of the hardenable trench forming composition. As known to those skilled in the art, the flotation force applied by a hardenable trench forming composition is approximately equal to the density of the material. Thus, concrete exerts a flotation form of about 120 pounds per cubic foot, for example. In order to effectively counterbalance these upwardly directed flotation forces and to prevent the form body from shifting position or being destroyed, the flotation force to which the buoyant form body is subjected must be less than or equal to the product of the surface area A operatively engages the buoyant form body to which resist upward movement thereof and the compressive strength of the form body $E_{FORM}$. For example, for a form body comprised of a foamed plastic having a density of 1 pound per cubic foot, the compressive strength of the foamed plastic form body is about 15 PSI. Thus, the surface area required to effectively counterbalance the upwardly directed flotation forces applied to the form body can be determined as:

$$A \geqq \frac{V_{Form}F}{E_{Form}}$$

The surface area A which operatively engages the buoyant form body 12 to resist the upward movement of the form body due to flotation forces applied thereto is typically the surface area of the downwardly facing engagement surface 46 of the counterbuoyancy members 42. As an example, the predetermined surface area of each engagement surface is preferably at least 30 square inches to effectively counterbalance the upwardly directed flotation forces applied by a hardenable trench forming composition having a density of 120 pounds per cubic foot to a portion of a typical form body having a compressive strength of 15 PSI and a volume of 3.5 cubic feet. However, the surface area of each engagement surface can vary while still effectively counterbalancing the upwardly directed flotation forces as described above without departing from the spirit and scope of the present invention.

In other embodiments in which the buoyant form body 12 includes generally upwardly facing surfaces 48 associated with the opposed side surfaces 16 and 18 for also engaging the lower surfaces of the frame members 22 and 24, the surface area A which operatively engages the buoyant form body to resist upward movement thereof includes not only the engagement surface 46 of the counterbuoyancy members 42, but also that portion of the lower surfaces of the frame members which engage the generally upwardly facing surfaces of the buoyant form body. Accordingly, in these instances, the size of the engagement surface of the counterbuoyancy member and, in turn, the size of the counterbuoyancy member can be reduced, if so desired.

Figure 8:
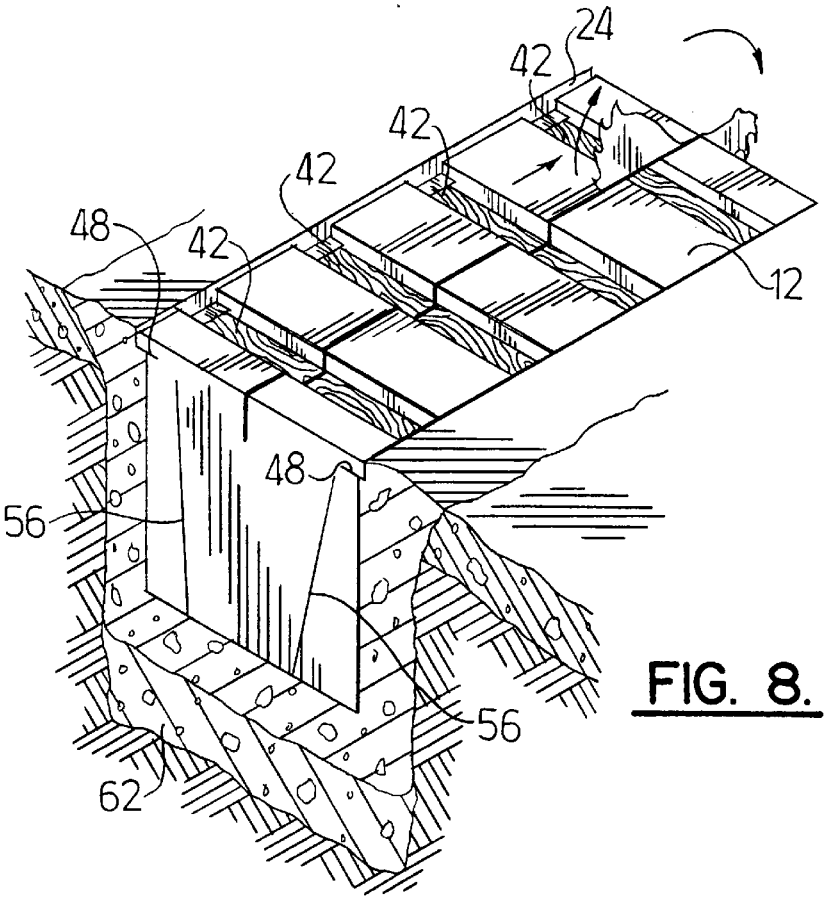
FIG. 8 is a perspective view illustrating the cutting of the counterbuoyancy members following hardening of the trench forming composition about the form body to thereby facilitate removal of the counterbuoyancy members and, in turn, the form body from the completed trench.

Following hardening of the trench forming composition, the counterbuoyancy members 42 are preferably removed. For example, the counterbuoyancy members can be cut, such as with a hand or circular saw, and removed as shown in FIG. 8. Thereafter, the form body 12 is preferably removed to expose the resulting trench. In the illustrated embodiment and as described in more detail in U.S. patent application Ser. No. 08/121,042, an upper portion of the form body is generally removed to expose the slots 56 defined by the form body which separate the form body into a central wedge-shaped piece and opposed side portions. The wedge-shaped piece of the form body can then be removed, followed by the removal of the side portions of the form body to expose the finished trench as shown in FIG. 9. As described above, however, the form body need not include upwardly extending slots and, consequently, can be removed from the trench in any number of other manner following the removal of the counterbuoyancy members without departing from the spirit and scope of the present invention. A grate or the trench cover 32 can then be placed on the frame members 22 and 24 so as to be supported by the horizontal portions 30 thereof between the vertical portions 28 thereof. Because the trench forming composition is poured fully around the side surfaces 16 and 18 and beneath the bottom surface 20 of the form body in a single pour, the pour line between the subslab structure 62 and the main pour does not intersect with the resulting trench, thereby enhancing the integrity of the trench.

The invention has been described in considerable detail with reference to its preferred embodiments. However, as indicated previously, the improved trench assemblies and methods of the present invention are susceptible to numerous alternatives and variations within the spirit and scope of the invention as described in detail in the foregoing specification and defined in the appended claims.

That which is claimed is:

1. An apparatus for forming a trench of a predetermined shape comprising:

a pair of elongate frame members defining an upper surface for supporting a trench cover and an opposed lower surface;

at least one downwardly extending leg connected to each of said elongate frame members;

a buoyant form body substantially defining the predetermined shape of the trench, said buoyant form body comprising an upper surface, opposing side surfaces and a bottom surface; and at least one counterbuoyancy member extending between said pair of elongate frame members, said counterbuoyancy member having an upper surface for operatively engaging the lower surface of each respective frame member and an engagement surface, opposite the upper surface, for operatively engaging a portion of the upper surface of said buoyant form body between said frame members, wherein the combination of said counterbuoyancy member, said pair of elongate frame members and said downwardly extending legs cooperate to substantially counterbalance said buoyant form body against upward flotation forces applied thereto by a hardenable trench forming composition poured around at least portions of said buoyant form body, and further wherein said engagement surface of said counterbuoyancy member has a sufficiently large surface area to prevent destructive deformation of said form body when the flotation forces are applied thereto.

2. A trench forming apparatus according to claim 1 wherein said buoyant form body extends lengthwise, and wherein said counterbuoyancy member extends laterally across said lengthwise extending buoyant form body.

3. A trench forming apparatus according to claim 2 wherein said at least one counterbuoyancy member comprises a plurality of laterally extending counterbuoyancy members spaced lengthwise along said buoyant form body.

4. A trench forming apparatus according to claim 2 wherein said buoyant form body and said counterbuoyancy member are sized such that end portions of said counterbuoyancy member are flush with adjacent portions of the respective side surfaces of said buoyant form body.

5. A trench forming apparatus according to claim 1 wherein said buoyant form body further comprises generally upwardly facing surfaces associated with said opposed side surfaces for engaging the lower surfaces of said frame members along at least a portion of the length thereof to further counterbalance said buoyant form body against upward flotation forces applied thereto by a hardenable trench forming composition poured around at least portions of said buoyant form body.

6. A trench forming apparatus according to claim 5 wherein the generally upwardly facing surfaces associated with the opposed side surfaces of said buoyant form body are substantially aligned with the upper surface of said counterbuoyancy member.

7. A trench forming apparatus according to claim 1 wherein said buoyant form body defines at least one groove in the upper surface thereof, wherein the at least one groove has a predetermined size adapted to receive a respective counterbuoyancy member.

8. A trench forming apparatus according to claim 1 wherein said counterbuoyancy member is comprised of a material having a greater strength of compression than the material forming said buoyant form body.

9. A trench forming apparatus according to claim 8 wherein said counterbuoyancy member is comprised of wood and said buoyant form body is comprised of a foamed plastic.

10. A trench forming apparatus according to claim 1 wherein said counterbuoyancy member is comprised of a material having a greater flexural strength than the material forming said buoyant form body.

11. A trench forming apparatus according to claim 1 wherein the upper surface of said counterbuoyancy member contacts the lower surface of each respective frame member, and wherein the engagement surface of said counterbuoyancy member contacts a portion of the upper surface of said buoyant form body between said frame members.

12. A trench forming apparatus according to claim 1 wherein said buoyant form body substantially defines the predetermined shape of an oil water separator having a volume of at least 25 cubic feet.

13. An apparatus for forming a trench of a predetermined shape comprising:

a pair of elongate frame members defining an upper surface for supporting a trench cover and an opposed lower surface, the lower surface of said frame members having a first predetermined width;

at least one downwardly extending leg connected to each of said elongate frame members;

a buoyant form body substantially defining the predetermined shape of the trench, said buoyant form body comprising an upper surface, opposing side surfaces and a bottom surface, said buoyant form body also having a predetermined volume and a predetermined compressive strength; and at least one counterbuoyancy member extending between and operatively engaging said pair of elongate frame members, to thereby maintain said frame members in a predetermined coplanar relationship, said counterbuoyancy member having a substantially downwardly facing engagement surface which has a predetermined surface area of at least about 30 square inches for operatively engaging a portion of the upper surface of said buoyant form body between said frame members, wherein the combination of said counterbuoyancy member, said pair of elongate frame members and said downwardly extending legs cooperate to substantially counterbalance said buoyant form body against upward flotation forces applied thereto by a hardenable trench forming composition poured around at least portions of said buoyant form body.

14. A trench forming apparatus according to claim 13 wherein said buoyant form body extends lengthwise, and wherein said counterbuoyancy member extends laterally across said lengthwise extending buoyant form body.

15. A trench forming apparatus according to claim 14 wherein said at least one counterbuoyancy member comprises a plurality of laterally extending counterbuoyancy members spaced lengthwise along said buoyant form body.

16. A trench forming apparatus according to claim 13 wherein said buoyant form body further comprises generally upwardly facing surfaces associated with said opposed side surfaces for engaging the lower surfaces of said frame members along at least a portion of the length thereof to further counterbalance said buoyant form body against upward flotation forces applied thereto by a hardenable trench forming composition poured around at least portions of said buoyant form body.

17. A trench forming apparatus according to claim 16 wherein the generally upwardly facing surfaces associated with the opposed side surfaces of said buoyant form body are substantially aligned with an upper surface of said counterbuoyancy member.

18. A trench forming apparatus according to claim 13 wherein said buoyant form body defines at least one groove in the upper surface thereof, wherein the at least one groove has a predetermined size adapted to receive a respective counterbuoyancy member.

19. A trench forming apparatus according to claim 13 wherein said counterbuoyancy member is comprised of a material having a greater strength of compression than the material forming said buoyant form body.

20. A trench forming apparatus according to claim 13 wherein said counterbuoyancy member has an upper surface, opposite the engagement surface, for contacting the lower surface of each respective frame member, and wherein the engagement surface of said counterbuoyancy member contacts a portion of the upper surface of said buoyant form body between said frame members.

21. An apparatus for forming a trench of a predetermined shape comprising:

a pair of elongate frame members defining an upper surface for supporting a trench cover and an opposed lower surface;

at least one downwardly extending leg connected to each of said elongate frame members;

an elongate buoyant form body substantially defining the predetermined shape of the trench, said buoyant form body comprising an upper surface, opposing side surfaces and a bottom surface, said buoyant form body further comprising generally upwardly facing surfaces associated with said opposed side surfaces for engaging the lower surfaces of said frame members along at least a portion of the length thereof; and at least one counterbuoyancy member extending between said pair of elongate frame members, said counterbuoyancy member including a downwardly facing engagement surface for operatively engaging a portion of the upper surface of said buoyant form body between said frame members, wherein the combination of said counterbuoyancy member, said pair of elongate frame members and said downwardly extending legs cooperate to substantially counterbalance said buoyant form body against upward flotation forces applied thereto by a hardenable trench forming composition poured around at least portions of said buoyant form body, and further wherein said engagement surface of said counterbuoyancy member has a sufficiently large surface area to prevent destructive deformation of said form body when the flotation forces are applied thereto.

22. A trench forming apparatus according to claim 21 wherein said buoyant form body defines at least one groove in the upper surface thereof, wherein the at least one groove has a predetermined size adapted to receive a respective counterbuoyancy member.

23. A trench forming apparatus according to claim 22 wherein the groove defined in the upper surface of said buoyant form body has a predetermined depth and said respective counterbuoyancy member has a predetermined thickness, and wherein the predetermined depth of the groove and the predetermined thickness of said counterbuoyancy member are selected such that an upper surface of said counterbuoyancy member, opposite the engagement surface, is substantially aligned with the generally upwardly facing surfaces associated with the opposed side surfaces of said buoyant form body.

24. A trench forming apparatus according to claim 21 wherein said at least one counterbuoyancy member comprises a plurality of laterally extending counterbuoyancy members spaced lengthwise along said buoyant form body.

25. A trench forming apparatus according to claim 21 wherein said counterbuoyancy member is comprised of a material having a greater strength of compression than the material forming said buoyant form body.

26. A trench forming apparatus according to claim 21 wherein said counterbuoyancy member is comprised of a material having a greater flexural strength than the material forming said buoyant form body.

27. A trench forming apparatus according to claim 21 wherein of said counterbuoyancy member has an upper surface, opposite the engagement surface, for contacting the lower surface of each respective frame member, and wherein the engagement surface of said counterbuoyancy member contacts a portion of the upper surface of said buoyant form body between said frame members.

28. A method of forming a trench of a predetermined shape comprising the steps of:

providing a trench forming apparatus comprising a pair of frame members defining an upper surface for supporting a trench cover and an opposed lower surface, at least one downwardly extending leg connected to each of the elongate frame members, a buoyant form body substantially defining the predetermined shape of the trench and comprising a bottom surface, opposing side surfaces and an upper surface, and at least one counterbuoyancy member extending between the pair of elongate frame members and having an upper surface and an opposed downwardly facing engagement surface;

engaging the lower surface of said frame member with the upper surface of the counterbuoyancy member and engaging a portion of the upper surface of the buoyant form body which extends between the frame members with the engagement surface of the counterbuoyancy member;

anchoring the downwardly extending legs of the trench forming apparatus in a predetermined location; and pouring a moldable trench forming composition around at least portions of the bottom surface and the aide surfaces of the buoyant form body, wherein the counterbuoyancy member cooperates with the pair of elongate frame members and the downwardly extending legs to hold the buoyant form body substantially against upward movement resulting from flotation forces introduced by the moldable trench forming composition poured around portions of the buoyant form body, and further wherein said engagement surface of said counterbuoyancy member has a sufficiently large surface area to prevent destructive deformation of said form body when the flotation forces are applied thereto.

29. A method according to claim 28 wherein said engaging step comprises distributing the upward flotation forces applied to the buoyant form body by the hardenable trench forming composition during said pouring step across the engagement surface of the counterbuoyancy member.

30. A method according to claim 28 wherein said providing step comprises providing a buoyant form body which includes generally upwardly facing surfaces associated with the opposed side surfaces for engaging the lower surfaces of the frame members along at least a portion of the length thereof to further counterbalance the buoyant form body against upward flotation forces applied thereto by the hardenable trench forming composition during said pouring step.

31. A method according to claim 30 wherein the generally upwardly facing surfaces of the buoyant form body contact the lower surfaces of the frame members along at least a portion of the length thereof.

32. A method according to claim 28 wherein the upper surface of the counterbuoyancy member contacts the lower surface of each respective frame member, and wherein the engagement surface of the counterbuoyancy member contacts a portion of the upper surface of the buoyant form body between the frame members.

33. A method according to claim 28 further comprising the step of removing the buoyant form body from the trench following hardening of the trench forming composition, said removing step comprising the steps of cutting the counterbuoyancy members prior to removing the counterbuoyancy members from the completed trench.

34. A method according to claim 28 wherein said providing step comprises the steps of:

providing a lengthwise extending buoyant form body; and extending a plurality of counterbuoyancy members laterally across the buoyant form body in a lengthwise spaced relationship.

35. A method according to claim 28 wherein said providing step comprises the steps of:

providing a buoyant form body which defines at least one groove in the upper surface thereof; and disposing a counterbuoyancy member in a respective groove such that the counterbuoyancy member extends between the frame members.

36. A method of forming a trench of a predetermined shape comprising the steps of:

providing a trench forming apparatus comprising a pair of elongate frame members defining an upper surface for supporting a trench cover and an opposed lower surface, at least one downwardly extending leg connected to each of the elongate frame members, at least one counterbuoyancy member extending between the pair of elongate frame members and having a downwardly facing engagement surface, and a buoyant form body substantially defining the predetermined shape of the trench and comprising a bottom surface, opposing side surfaces and an upper surface, wherein said buoyant form body further comprises generally upwardly facing surfaces associated with said opposed side surfaces;

engaging a portion of the upper surface of the buoyant form body between the frame members with the engagement surface of the counterbuoyancy member and engaging the upwardly facing surfaces of the buoyant form body with the lower surfaces of the elongate frame members along at least a portion of the length thereof;

anchoring the downwardly extending legs of the trench forming apparatus in a predetermined location; and pouring a moldable trench forming composition around at least portions of the bottom surface and the side surfaces of the buoyant form body, wherein the combination of the counterbuoyancy member, the pair of elongate frame members and the downwardly extending legs cooperate to hold the buoyant form body substantially against upward movement resulting from flotation forces introduced by the moldable trench forming composition poured around portions of the buoyant form body, and further wherein said engagement surface of said counterbuoyancy member has a sufficiently large surface area to prevent destructive deformation of said form body when the flotation forces are applied thereto.

37. A method according to claim 36 wherein said engaging step further comprises distributing the upward flotation forces applied to the buoyant form body by the hardenable trench forming composition during said pouring step across the engagement surface of the counterbuoyancy member.

38. A method according to claim 36 wherein said engaging step comprises contacting the generally upwardly facing surfaces of the buoyant form body with the lower surfaces of the frame members along at least a portion of the length thereof.

39. A method according to claim 36 wherein said engaging step comprises contacting a portion of the upper surface of the buoyant form body between the frame members with the engagement surface of the counterbuoyancy member.

40. A method according to claim 36 wherein he counterbuoyancy member further comprises an upper surface opposite the engagement surface, and wherein he method comprises engaging the lower surfaces of the frame members with the upper surface of the counterbuoyancy member.

41. A method according to claim 36 further comprising the step of removing the buoyant form body from the trench following hardening of the trench forming composition, said removing step comprising the steps of cutting the counterbuoyancy members prior to removing the counterbuoyancy members from the completed trench.

42. A method according to claim 36 wherein said providing step comprises the steps of:

providing a lengthwise extending buoyant form body; and extending a plurality of counterbuoyancy members laterally across the buoyant form body in a lengthwise spaced relationship.

43. A method according to claim 36 wherein said providing step comprises the steps of:

providing a buoyant form body which defines at least one groove in the upper surface thereof; and disposing a counterbuoyancy member in a respective groove such that the counterbuoyancy member extends between the frame members.

* * * * *

UNITED STATES PATENT AND TRADEMARK OFFICE
CERTIFICATE OF CORRECTION

PATENT NO. : 5,890,839

DATED : April 6, 1999

INVENTOR(S) : Gunter

It is certified that error appears in the above-identified patent and that said Letters Patent is hereby corrected as shown below:

Column 15, line 33, "aide" should read --side--.

Column 17, lines 8 and 10, "he" should read --the--.

Signed and Sealed this

Seventh Day of September, 1999

*Attest:*

Q. TODD DICKINSON

*Attesting Officer*

*Acting Commissioner of Patents and Trademarks*